US005338233A

United States Patent [19]

Endo et al.

[11] Patent Number: 5,338,233

[45] Date of Patent: Aug. 16, 1994

[54] STRUCTURE FOR ELECTRICALLY CONNECTING A TERMINAL AND A WIRE

[75] Inventors: Mitsuo Endo; Nobuyuki Asakura, both of Shizuoka, Japan

[73] Assignee: Yazaki Corporation, Japan

[21] Appl. No.: 42,792

[22] Filed: Apr. 6, 1993

[30] Foreign Application Priority Data

Apr. 8, 1992 [JP] Japan ..... 4-021586[U]

[51] Int. Cl.[5] ..... H01R 4/24; H01R 4/26

[52] U.S. Cl. ..... 439/877; 439/865

[58] Field of Search ..... 439/865, 877

[56] References Cited

U.S. PATENT DOCUMENTS 2,142,818 1/1939 Jacobson ..... 439/865

3,032,602 5/1962 Farnell ..... 439/877 X

FOREIGN PATENT DOCUMENTS 5748059 10/1982 Japan .

8807771 10/1988 PCT Int'l Appl. ..... 439/877

*Primary Examiner*—Eugene F. Desmond

*Attorney, Agent, or Firm*—Wigman, Cohen, Leitner & Myers

[57] ABSTRACT

A wire has a conductor member and an insulation member covering the conductor member. A terminal has a wire connecting portion. The wire connecting portion has a conductor crimp portion for crimping said conductor member and an insulator crimp portion for crimping the insulation member together with the conductor member. The conductor crimp portion comprises a main body and a pair of crimp pieces extending from the main body. The crimp pieces have engaging portions which are electrically connected to the conductor member and engaged with each other when the crimp pieces are crimped.

8 Claims, 4 Drawing Sheets

STRUCTURE FOR ELECTRICALLY CONNECTING A TERMINAL AND A WIRE

BACKGROUND OF THE INVENTION

This invention relates to a structure for electrically connecting a terminal and a wire.

FIGS. 1 and 2 illustrate a conventional terminal. The terminal 1 is made of an electroconductive plate through a die-cutting process. The terminal 1 comprises an electric contact portion 3 and a wire connecting portion 5. The electric contact portion 3 is adapted to be connected to a mating terminal and has a coupling hole 3*a*. The wire connecting portion 5 is for connection with a wire 15. The wire connecting portion 5 is formed into a U-shape and comprises an insulator crimp portion 11 and a conductor crimp portion 13. The insulator crimp portion 11 is for crimping an insulation 9 which covers a core wire (conductor member) 7 of the cable 15. The conductor crimp portion 13 is for crimping the core wire 7 which is exposed after the insulation 9 is removed. The insulator crimp portion 11 has a pair of crimp pieces 11*a* and 11*b* while the conductor crimp portion 13 has a pair of crimp pieces 13*a* and 13*b* .

In order to connect the terminal 1 to an end portion of the wire 15, the core wire (conductor member) 7 is mounted on the conductor crimp portion 13 while the insulation 9 covering the core wire 7 is mounted on the insulator crimp portion 11. By the use of a crimper and an anvil (not shown), the crimp pieces 13*a* and 13*b* of the conductor crimp portion 13 and the crimp pieces 11*a* and 11*b* of the insulator crimp portion 11 are downwardly bent into an inverted U shape.

In the above-mentioned conventional terminal 1, however, top ends 17 of the conductor crimp portion 13 are simply embedded into the core wire 7. When subjected to an excessive tensile force along the longitudinal axis of the cable, the core wire 7 possibly be moved and dislocated in the longitudinal direction with respect to the conductor crimp portion 13. Thus, the conventional terminal 1 is unreliable in mechanical and electrical connection.

SUMMARY OF THE INVENTION

It is an object of this invention to provide a structure for electrically connecting a terminal and a wire, which is capable of improving a reliability in mechanical and electrical connection between a core wire of the wire and a wire connecting portion of the terminal In order to achieve the above-mentioned object, this invention provides a structure for electrically connecting a terminal and a wire, comprising:

a wire having a conductor member; and a terminal having a wire connecting portion for connection with the wire, the wire connecting portion having a main body and a pair of crimp pieces extending from the main body, the crimp pieces having engaging portions which are electrically connected to the conductor member and engaged with each other when the crimp pieces are crimped.

According to this invention, the engaging portions are formed at the top ends of a pair of the crimp pieces of the wire connecting portion. When an end portion of the wire is connected to the terminal, the engaging portions are engaged with each other in a crimped state. Even if a tensile force is applied along the longitudinal direction of the wire, the wire is inhibited by the engaging portions from being moved with respect to the wire connecting portion. Accordingly, it is possible to improve a reliability in mechanical and electrical connection between a core wire and an insulator crimp portion.

DESCRIPTION OF THE PREFERRED EMBODIMENT

Now, description will be made as regards a crimp structure of a terminal according to this invention.

Figure 1:
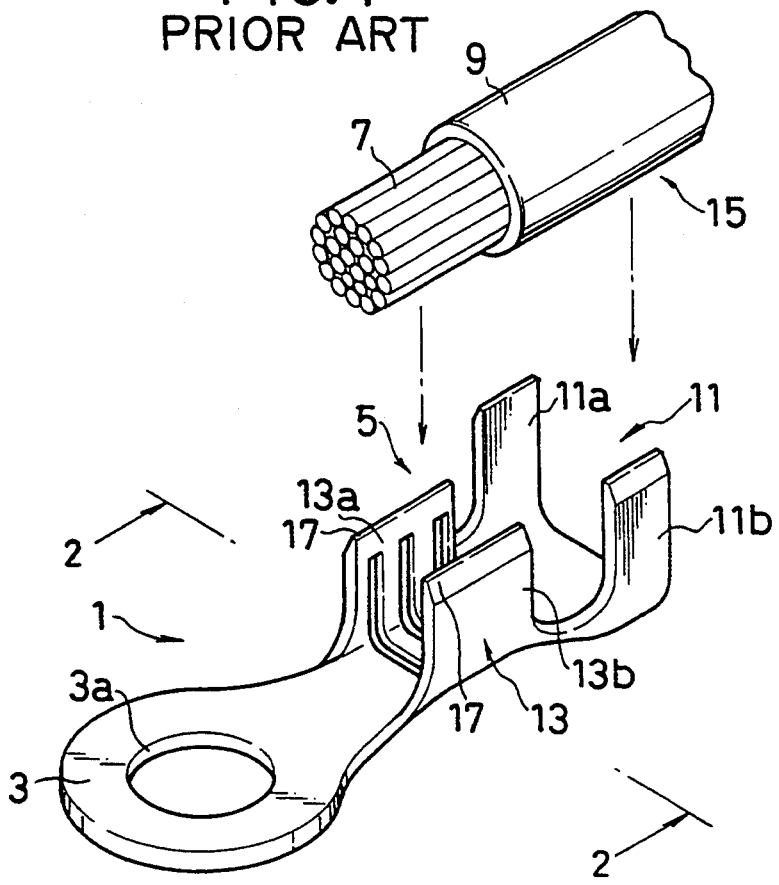
FIG. 1 PRIOR ART
FIG. 1 is a perspective view of a conventional terminal.
Figure 2:
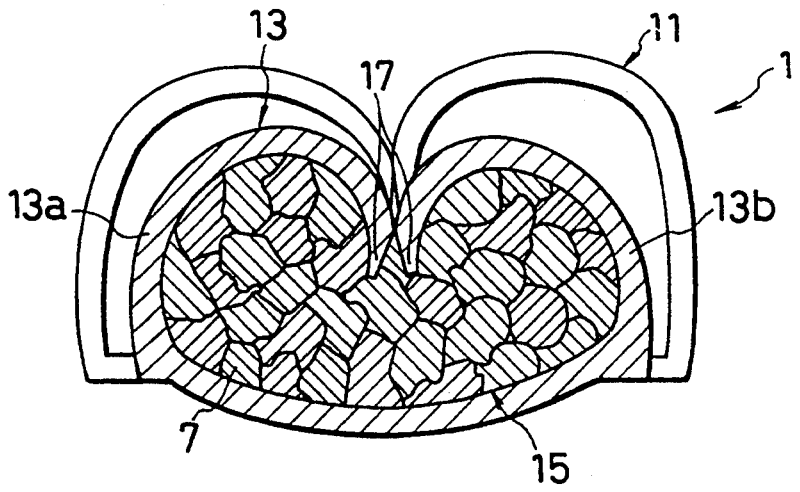
FIG. 2 PRIOR ART
FIG. 2 is a sectional view of the conventional terminal with a wire crimped by the terminal.
Figure 3:
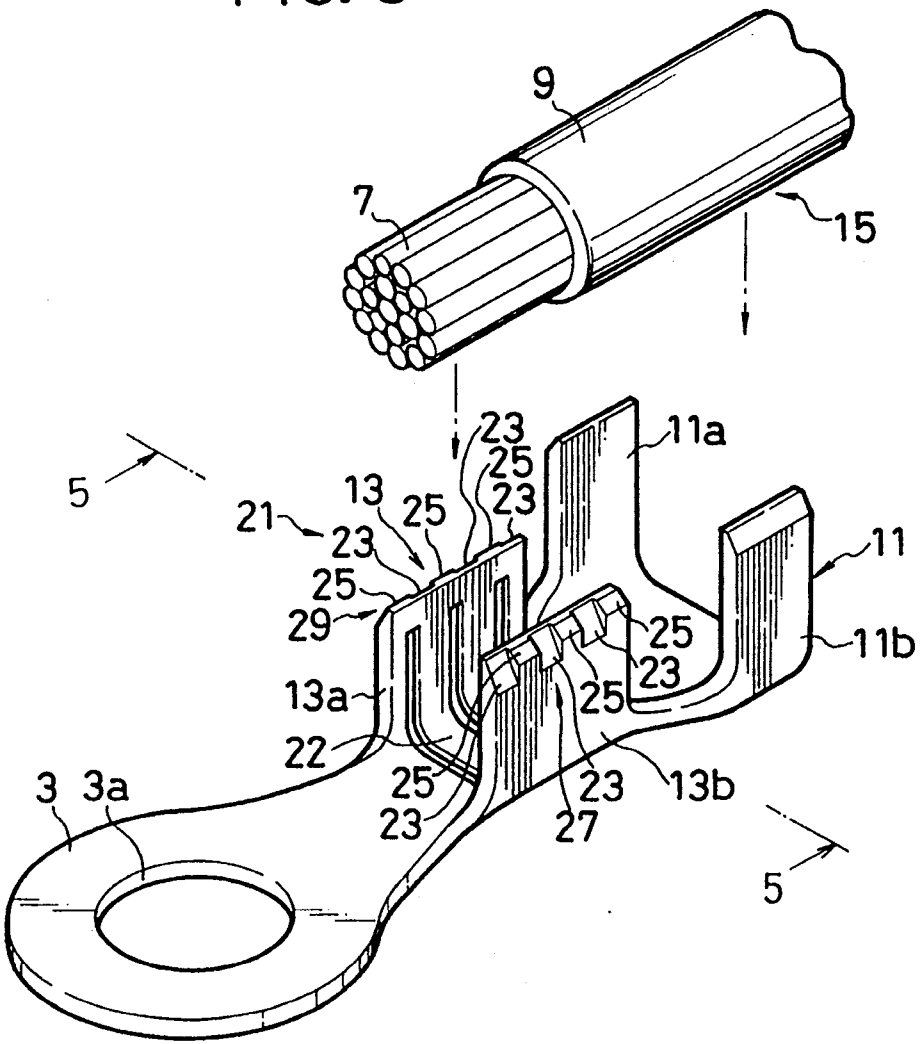
FIG. 3 is a perspective view of a wire and a terminal having a crop structure according to this invention.

As illustrated in FIG. 3, a terminal 21 according to this embodiment comprises an electric contact portion 3 and a wire connecting portion 5 at one end and the other end, respectively. The electric contact portion 3 is adapted to be connected to a mating terminal and has a connection hole 3*a*. The wire connecting portion 5 comprises a conductor crimp portion 13 and an insulator crimp portion 11. The conductor crimp portion 13 has a pair of crimp pieces 13*a* and 13*b* extending from a main body 22 of the wire connecting portion 5. Likewise, the insulator crimp portion 11 has a pair of crimp pieces 11*a* and 11*b* extending from the main body 22. The conductor crimp portion 13 and the insulator crimp portion 11 are formed into a U-shape.

Figure 4:
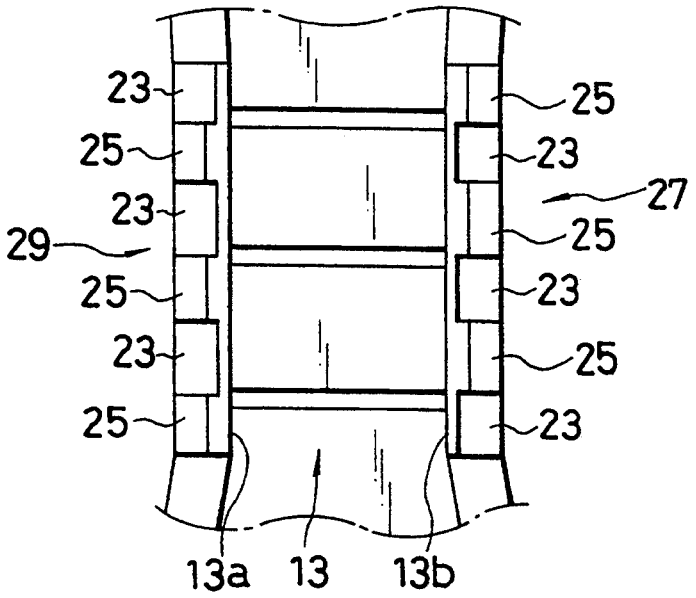
FIG. 4 is a plan view of top ends of a pair of crimp pieces of the terminal illustrated in FIG. 3.
Figure 7:
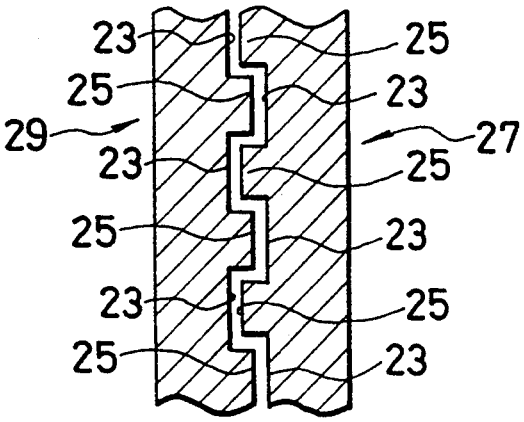
FIG. 7 is a sectional view of engaging portions of a pair of the crimp pieces of the terminal illustrated in FIG. 3, taken along a line 7—7 in FIG. 6.

As illustrated in FIGS. 3 and 4, a plurality of engaging portions 27 and 29 are formed at top ends of the crimp pieces 13*a* and 13*b* of the conductor crimp portion 13. Each of the engaging portions 27 and 29 includes groove portions 23 and protrusion portions 25. The groove portions 23 and the protrusion portions 25 extend towards the top edge of each of the crimp pieces 13*a* and 13*b* in an alternate arrangement. As illustrated in FIG. 7, the protrusion portions 25 of the crimp piece 13*b* are inserted into the groove portions 23 of the crimp piece 13*a* while the protrusion portions 25 of the crimp piece 13*a* are inserted into the groove portions 23 of the crimp piece 13*b* . Thus, the engaging portions 27 and 29 of the crimp pieces 13*a* and 13*b* are engaged with each other.

Figure 5:
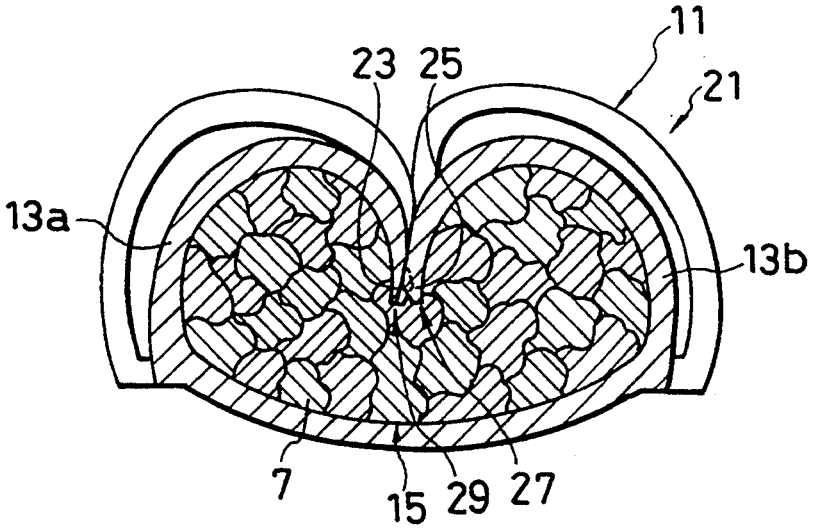
FIG. 5 is a sectional view of the terminal illustrated in FIG. 3 with the wire crimped by a conductor crimp portion.
Figure 6:
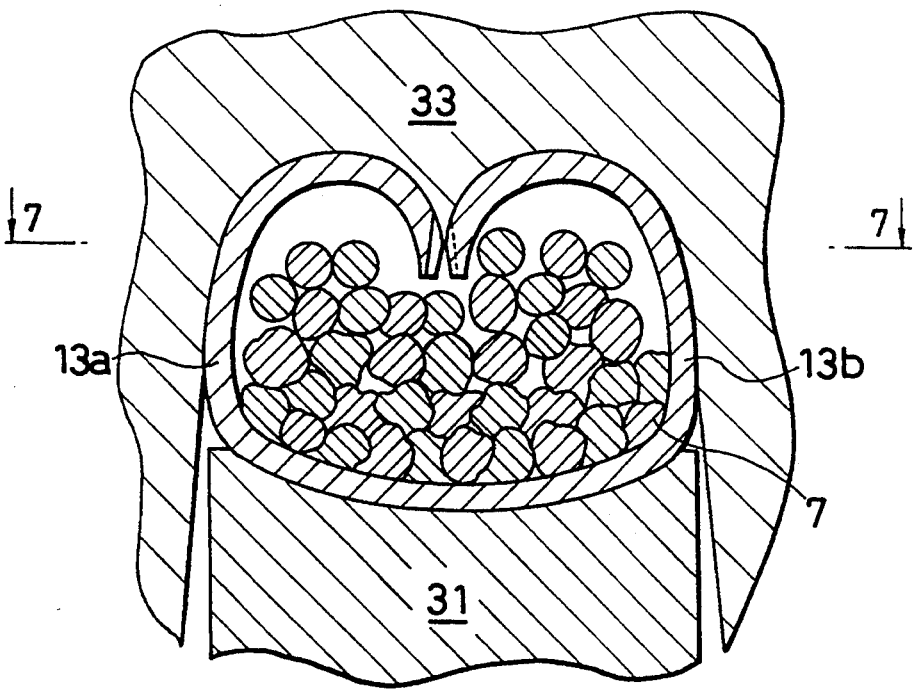
FIG. 6 is a sectional view of the terminal illustrated in FIG. 3 with the wire crimped between a crimper and an anvil.

In order to connect a wire 15 to the terminal 21, a core wire (conductor member) 7 of the wire 15 is mounted on the conductor crimp portion 13. Likewise, an insulation 9 is mounted on the insulator crimp portion 11 together with the core wire 7. In this state, the terminal 21 is mounted on an anvil 31 and pressed between a crimper 33 and the anvil 31, as illustrated in FIG. 6 Thus, as illustrated in FIG. 5, the conductor crimp portion 13 is downwardly crimped into an inverted U shape. Top ends 27 and 29 of the crimp pieces 13*a* and 13*b* are embedded into the core wire 7. The engaging portions 27 and 29 of the crimp pieces 13*a* and 13*b* are engaged with each other. When the conductor crimp portion 13 is further crimped, the engaging portions 27 and 29 are embedded into the core wire 7.

According to this invention, a pair of the crimp pieces 13*a* and 13*b* are inhibited from relative movement along the longitudinal direction of the wire 15. Even if a tensile force is applied along the longitudinal direction of the wire 15, the core wire 7 is never moved with respect to the conductor crimp portion 13. Since the engaging portions 27 and 29 are engaged in the core wire 7, a contact area between the core wire 7 and the conductor crimp portion 13 is increased. This improves a reliability in electrical connection.

Since the engaging portions 27 and 29 have acute ends, the top ends 27 and 29 of the crimp pieces 13*a* and 13*b* are readily embedded into the core wire 7.

In the foregoing embodiment, a plurality of the groove portions 23 and the protrusion portions 25 are formed on the crimp pieces 13*a* and 13*b*. However, only two protrusion portions 25 and only one protrusion portion 25 may be formed on one and the other of the crimp pieces 13*a* and 13*b*, respectively. In this case, engagement is carried out between a single pair of the groove and the protrusion portions.

What is claimed is:

1. A structure for electrically connecting a terminal and a wire, comprising:

a wire having a conductor member and an insulation member covering said conductor member; and a terminal having a wire connecting portion, said wire connecting portion having a conductor crimp portion for crimping said conductor member and an insulation crimp portion for crimping said insulation member together with said conductor member, said conductor crimp portion including a main body and a pair of crimp pieces extending from said main body, said crimp pieces having acute distal ends and a protrusion formed on an outer surface of one crimp piece adapted to engage with a groove formed on an outer surface of the other crimp piece when said crimp pieces are crimped together and imbedded into said conductor member.

2. A structure for electrically connecting a terminal and a wire as claimed in claim 1, wherein:

each of said crimp pieces comprises a plurality of grooves and a plurality of protrusions formed on the outer surfaces of said crimp pieces.

3. A structure for electrically connecting a terminal and a wire, comprising:

a wire having a conductor member and an insulation member covering said conductor member; and a terminal having a wire connecting portion including a conductor crimp portion for crimping said conductor and an insulation crimp portion for crimping said insulation member together with said conductor member, said conductor crimp portion including a main body and a pair of crimp pieces extending from said main body, and a protrusion and a groove formed on the outer surfaces of said crimp pieces, said protrusion and said groove being engaged together when said crimp pieces are crimped together and imbedded into said conductor member.

4. A structure for electrically connecting a terminal and a wire as claimed in claim 3, further comprising a plurality of protrusions and a plurality of grooves formed on said crimp pieces.

5. A structure for electrically connecting a terminal and a wire, comprising:

a wire having a conductor member and an insulation member covering said conductor member; and a terminal having a wire connecting portion including a conductor crimp portion for crimping said conductor and an insulator crimp portion for crimping said insulation together with said conductor member, said conductor crimp portion including a main body and a pair of crimp pieces extending from said main body and a protrusion and a groove formed on outer surfaces of said crimp pieces, a distal end of each of said crimp pieces being linearly formed in a longitudinal direction of the wire, each of said distal ends having an acute angle in a cross-section taken in a plane perpendicular to the longitudinal direction of the wire, said protrusion and said groove being engaged together when said distal ends are imbedded into said conductor member when said crimp pieces are crimped together.

6. A structure for electrically connecting a terminal and a wire as claimed in claim 5, further comprising a plurality of protrusions and a plurality of grooves formed on said crimp pieces.

7. A structure for electrically connecting a terminal and a wire as claimed in claim 6, wherein said protrusions and said grooves are arrayed in alternating order.

8. A structure for electrically connecting a terminal and a wire as claimed in claim 6, wherein said protrusions formed on one crimp piece correspond to in number said grooves formed on the other crimp piece.

* * * * *